US012232659B2

(12) United States Patent
Oliver et al.

(10) Patent No.: US 12,232,659 B2
(45) **Date of Patent: *Feb. 25, 2025**

(54) RECONFIGURABLE WATER DISTRIBUTION SYSTEM FOR A WALK-IN TUB BATHING INSTALLATION WITH A SINGLE PUMP FOR MULTIPLE FUNCTIONS

(71) Applicant: Daniel Oliver, Linden, TN (US)

(72) Inventors: Daniel Oliver, Linden, TN (US); Eric J. Kownacki, Rancho Bernardo, CA (US); Graham J. Campbell, Irvine, CA (US)

(73) Assignee: Daniel Oliver, Hohenwald, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/142,102

(22) Filed: May 2, 2023

(65) Prior Publication Data

US 2023/0270293 A1 Aug. 31, 2023

Related U.S. Application Data

(62) Division of application No. 17/081,881, filed on Oct. 27, 2020, now Pat. No. 11,659,963, which is a division of application No. 16/195,529, filed on Nov. 19, 2018, now Pat. No. 10,874,260.

(51) Int. Cl.
*A47K 3/02* (2006.01)
*A47K 3/10* (2006.01)

(52) U.S. Cl.
CPC . *A47K 3/02* (2013.01); *A47K 3/10* (2013.01)

(58) Field of Classification Search
CPC ..... A47K 3/02; A47K 3/10
USPC ..... 4/541.1
See application file for complete search history.

(56) References Cited

U.S. PATENT DOCUMENTS

| | | | |
|---|---|---|---|
| 210,334 | A | 11/1878 | Kinsmen |
| 1,805,560 | A | 5/1931 | Barta |
| 3,863,275 | A | 2/1975 | Brendgard |
| 4,716,605 | A | 1/1988 | Shepherd |
| 4,907,305 | A | 3/1990 | Teramachi |
| 4,974,310 | A | 12/1990 | Altman |

(Continued)

FOREIGN PATENT DOCUMENTS

JP 2002364933 12/2002

OTHER PUBLICATIONS

American Standard, Drain Overflow Installation, Quick Drain, www.americanstandard-us.com, American Standard (at least as early as Apr. 14, 2015).

(Continued)

*Primary Examiner* — Huyen D Le
(74) *Attorney, Agent, or Firm* — Baker Donelson; Carl M. Davis, II

(57) ABSTRACT

A reconfigurable water distribution system for a walk-in tub bathing installation including two or more types of discharge ports for discharging water. The system includes a single motorized pump having an input connected to a suction port of the bathing installation, and an output port delivering pressurized water. A pipe system selectively connects the pump to the two or more types of discharge ports to selectively direct the pressurized water to the different ones of the types of discharge ports. The system selectively enables the bathing installation to perform a plurality of different functions using a single pump.

8 Claims, 7 Drawing Sheets

(56) References Cited

U.S. PATENT DOCUMENTS

| | | | | |
|---|---|---|---|---|
| 5,012,535 | A * | 5/1991 | Klotzbach | A61H 33/027 4/541.4 |
| 5,123,123 | A | 6/1992 | Hart | |
| 5,351,345 | A | 10/1994 | Sills | |
| 5,570,481 | A | 11/1996 | Mathis | |
| 5,604,940 | A | 2/1997 | Shimizu | |
| 5,898,958 | A | 5/1999 | Hall | |
| 7,440,864 | B2 * | 10/2008 | Otto | A61H 33/60 307/11 |
| 7,886,372 | B2 | 2/2011 | Jacobs | |
| 8,407,823 | B2 | 4/2013 | Sorensen | |
| 8,549,678 | B2 * | 10/2013 | Neidich | A47K 3/006 4/538 |
| 8,683,622 | B2 | 1/2014 | Ciechanowski | |
| 8,720,867 | B2 | 5/2014 | Cunningham | |
| 9,066,635 | B2 | 6/2015 | Campbell | |
| 10,071,018 | B2 * | 9/2018 | Tempas | A61H 33/028 |
| 10,655,309 | B1 | 5/2020 | Oliver | |
| 10,881,251 | B2 | 5/2021 | Manchiraju | |
| 11,085,178 | B1 | 8/2021 | Oliver | |
| 11,522,326 | B2 * | 12/2022 | Campbell | A61H 33/0087 |
| 11,659,963 | B2 | 5/2023 | Oliver | |
| 2005/0005349 | A1 | 1/2005 | Gardenier | |
| 2008/0189847 | A1 | 8/2008 | Yamasaki | |
| 2015/0366752 | A1 | 12/2015 | Hatley | |
| 2016/0271012 | A1 | 9/2016 | Xu | |
| 2017/0258274 | A1 | 9/2017 | Lee | |
| 2020/0154951 | A1 | 5/2020 | Kownacki | |
| 2022/0110489 | A1 | 4/2022 | Oliver | |

OTHER PUBLICATIONS

American Standard, Speed Connect.RTM. Drain, www.americanstandard-us.com/learn/american-standard-advantage/innovations- /speed-connect, (at least as early as Apr. 14, 2015).

Safety Tubs LLC, electrical circuit diagrams, 2009.

Safety Tubs LLC, Safety Tubs luxury 60"×32" walk-in tub, www.safetytubs.com/acrylictubs/603237_options.php, Safety Tubs LLC, 902 West, North Carrier Parkway, Grand Prairie, TX 75050 (at least as early as Apr. 14, 2015).

Safety Tubs LLC, Walk-In Bath Installation Instructions and Owner's Manual, pp. 16, 20, and 24, Safety Tubs LLC, 902 West, North Carrier Parkway, Grand Prairie, TX 75050 (at least as early as Apr. 14, 2015).

Safety Tubs LLC, Minute Drain, Safety Tubs LLC, 902 West, North Carrier Parkway, Grand Prairie, TX 75050 (at least as early as Apr. 14, 2015).

* cited by examiner

FIG. 1
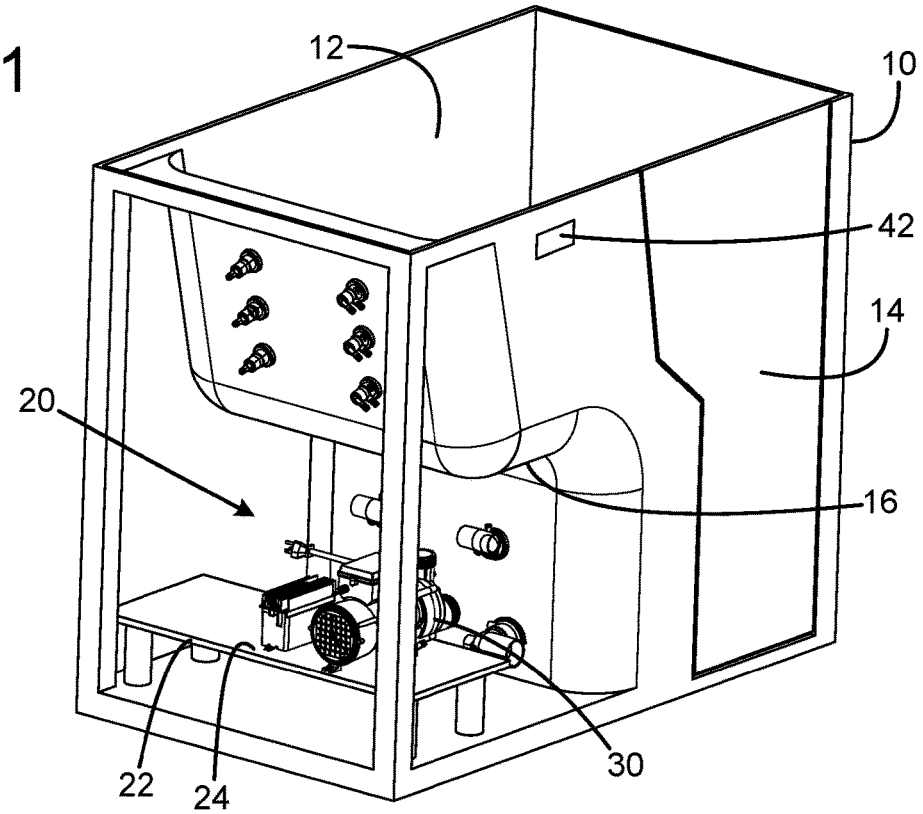
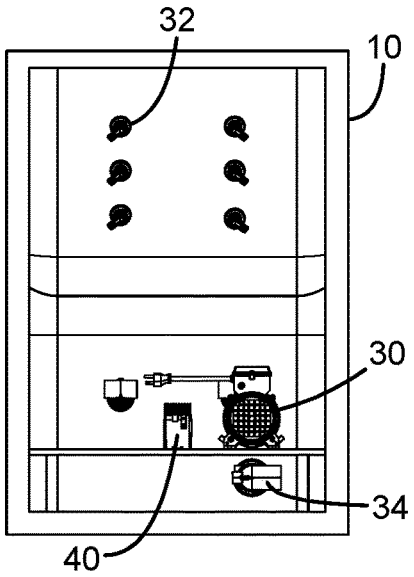
FIG. 2
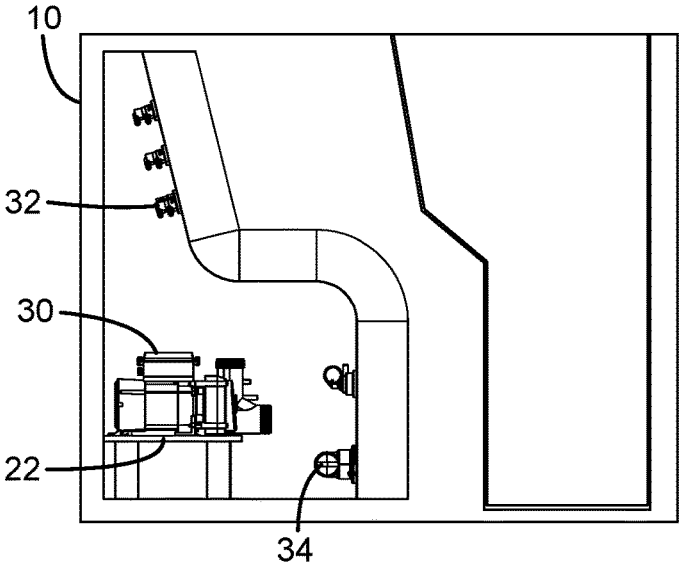
FIG. 3

RECONFIGURABLE WATER DISTRIBUTION SYSTEM FOR A WALK-IN TUB BATHING INSTALLATION WITH A SINGLE PUMP FOR MULTIPLE FUNCTIONS

CROSS-REFERENCE TO RELATED APPLICATION

This application claims the benefit of U.S. application Ser. No. 16/195,529 filed Nov. 19, 2018, the entire contents of which are hereby incorporated by reference.

BACKGROUND

Walk-in bathtubs provide easier ingress and egress through a water-tight, hinged door, and provide a seat for the bather. In walk-in bathtubs, there are multiple types of therapies and functions which can be provided, such as a whirlpool system with bath jets, a micro nano bubbles system with small jets, an air system, lights, heating pads, and a rapid water discharge system.

In the current walk-in baths on the market, the whirlpool, micro nano bubbles and rapid water discharge systems each require a separate pump. This is a two-fold problem as the pumps are expensive and there is very limited real estate underneath the bathtub to fit the components, plumbing and the electronics to operate the tub. The available space is generally confined to a compartment below the seat.

BRIEF SUMMARY OF THE INVENTION

The present invention meets the need in the art. The present invention provides a reconfigurable water distribution system for a walk-in tub bathing installation including two types of discharge ports for discharging water, the system comprising a single motorized pump having an input connected to a suction port of the bathing installation, and an output port delivering pressurized water and a pipe system connecting the outlet port of the pump to two types of discharge ports, the pipe system including a valve to configure a first water path and a second water path between the valve and a respective one of the two types of discharge ports to selectively direct the pressurized water to one of the two types of discharge ports. Said pipe system includes a first pipe section connecting the pump output port to an input port of the valve, said first water path comprises a second pipe section connected between a first outlet port of the valve and the first type of discharge ports, and said second water path comprises a third pipe section connected between a second outlet port of the valve and the second type of discharge ports. A first type of discharge ports is one or more bath jets, and wherein when setting the valve to direct pressurized water to the first type of discharge ports, a bath jetting function is performed. A second type of discharge ports is a drain discharge port for discharging pressurized water from the walk-in bathing installation for rapid draining to a sanitary drain, and wherein when water is directed to the second type of discharge ports, a drain function is performed. Wherein the valve in a first valve position directs water flow to the one or more bath jets, and in a second valve position prevents water flow to the one or more bath jets and allows water flow to the sanitary drain. The water distribution system selectively enables the walk-in bathing installation to perform at least two different functions using a single pump.

In another aspect, the present invention provides a walk-in bath tub installation comprising a walk-in bath tub having a drain system, and one or more bath jets fitted in one or more walls of the tub to provide a whirlpool function, a seat, and a reconfigurable water distribution system. The reconfigurable water distribution system comprises a single motorized pump having an input connected to a suction port of the tub, and an output port delivering pressurized water. A pipe system connects the pump output port to the one or more bath jets and to the drain system, the pipe system including a valve to configure water paths between the pump, the one or more bath jets and the drain system to selectively direct the pressurized water to either the one or more bath jets to perform a whirlpool function and to the drain system for-a bath draining function.

BRIEF DESCRIPTION OF THE DRAWINGS

Features and advantages of the disclosure will readily be appreciated by persons skilled in the art from the following detailed description when read in conjunction with the drawing wherein:

FIG. 1 is a partially broken-away, diagrammatic isometric view of an exemplary embodiment of a walk-in tub installation.

FIG. 2 is a diagrammatic end view of the tub installation of FIG. 1.

FIG. 3 is a partially broken-away, diagrammatic side view of the tub installation of FIG. 1.

DETAILED DESCRIPTION

Figure 4:
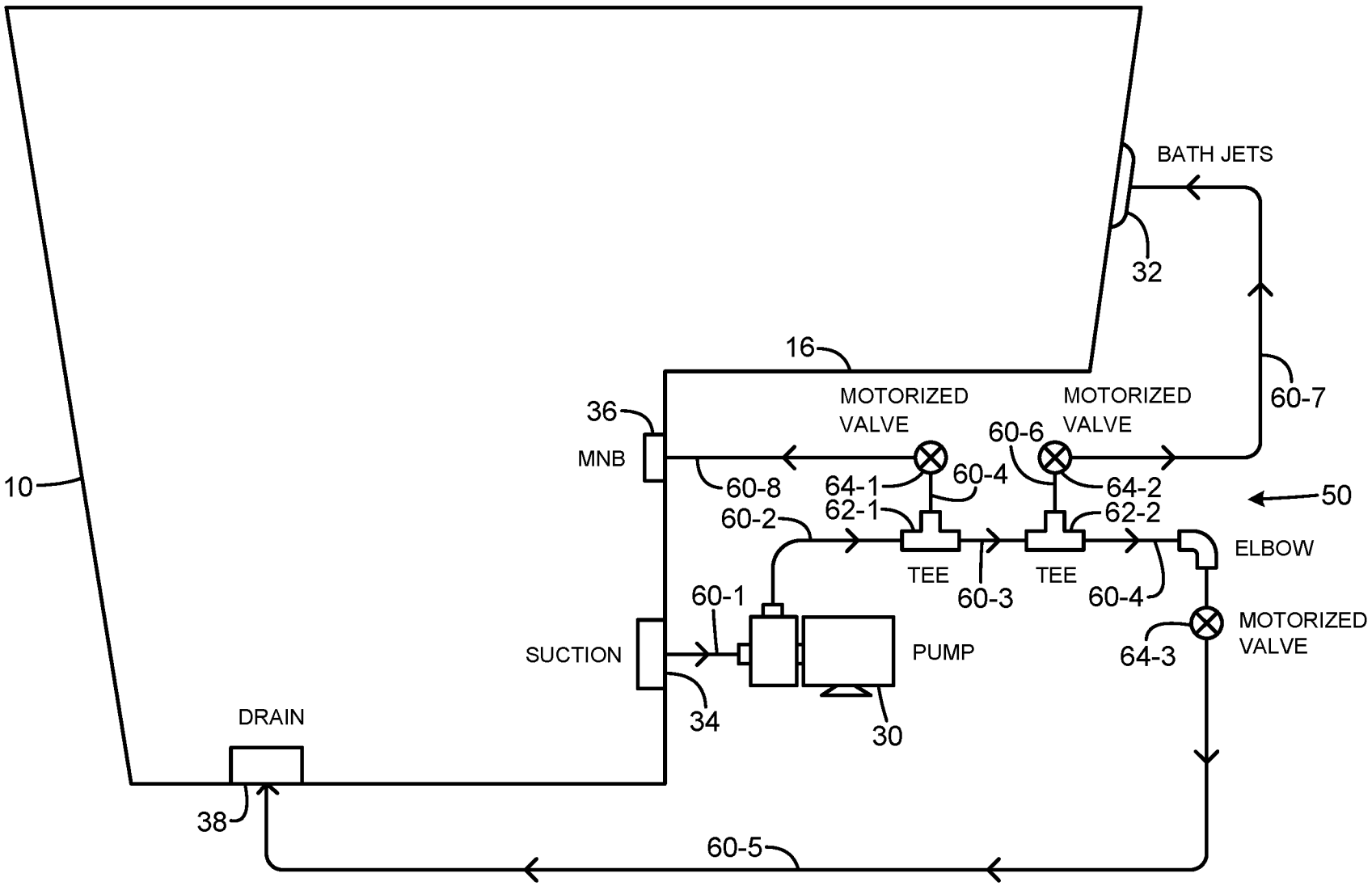
FIG. 4 is a simplified schematic diagram illustrating an exemplary embodiment of a water distribution system employing a single pump to operate three functions in a walk-in tub installation.

In the following detailed description and in the several figures of the drawing, like elements are identified with like reference numerals. The figures are not to scale, and relative feature sizes may be exaggerated for illustrative purposes.

A walk-in tub installation is shown in FIGS. 1-3. The installation includes a tub structure 10 which includes a water reservoir defined by the tub structure, and a door 14 which swings on hinges from a water-tight closed position (shown in FIGS. 1-3), and an open position which allows the user ready egress into and from the water reservoir. Typically, the tub structure 10 defines a seat platform 16 for the user to sit while bathing with the door closed, and water filling the reservoir to a comfortable level for the user.

Manual valve elements (not shown in FIGS. 1-3) allow the user to control the filling of the bathing water into the tub reservoir.

The tub structure 10 defines an open space 20 under and behind the seat 16, into which the tub installation pump, control and water pipes are installed. This space can be quite limited in volume, with the installation equipment mounted to a platform 22. The equipment includes a motor driven pump 30, and an electronic controller unit 24. A user interface control panel 42 is positioned for ready access by the user, to control operation of the tub functions.

The tub installation includes a network of water jets 32, through which water is pumped by the pump under pressure to provide a therapeutic effect for the user. A recirculating water flow path is provided, with the pump drawing bathing water from the reservoir through a suction fitting 34, and direct pressurized water from the pump to the water jets 32. This is a first function provided by the installation.

Another function which may be implemented in an exemplary embodiment is a rapid water discharge function, activated by the user once finished bathing, to actively pump water out from the reservoir into the drain, to speed up the tub drain process so that the user when finished bathing, may open the door 14 without water escaping through the door opening. This function may be implemented by use of the pump 30 as well, without requiring a separate pump dedicated to the rapid water discharge function.

Another function which may be implemented in an exemplary embodiment is a micro-nano bubble (MNB) function, in which water and entrained air is forced through a small jet or a network of small jets, typically known as MNB jets, positioned in the tub walls. This function delivers air-entrained water to the small jets, creating a milk-water effect. This MNB function may be implemented in an exemplary embodiment without requiring a separate pump dedicated to this function. In this embodiment, air is entrained in the water at the pump.

In accordance with aspects of the invention, two or more functions can be realized in a bathing installation, such as a walk-in tub, with a reconfigurable water distribution system including a pipe network, a single pump and one or more valves, typically motorized valves controlled by the controller 24, in accordance with user commands entered on a control panel mounted on the tub structure. The valves are typically controlled by signals from the controller 24. Several embodiments are described below, with respect to FIGS. 4-9.

FIG. 4 illustrates in schematic form a walk-in tub installation employing a reconfigurable water distribution system 50 which provides three functions, a water jet function, an MNB function and a rapid water discharge, with a single pump 30. In this embodiment, the functions may be performed one at a time, with the function selected by the setting of three valves 64-1, 64-2 and 64-3 arranged in the pipe network. The pipe network in this embodiment includes several sections. Pipe section 60-1 connects between the suction fitting in the tub wall to the suction port of the pump 30, and allows water to be drawn from the reservoir for pumping from the suction port through the pump. Pipe section 60-2 connects to a T fitting 62-1, with the T port connected to pipe section 60-4, and the through port connected to pipe section 60-3. The pipe section 60-4 is connected to a port of a two-port motorized valve 64-1; the other port of the valve is connected to pipe manifold section 60-8, which is connected to the MNB jets 36. The valve 64-1 in this embodiment is an on-off valve, so that in the off position, no water or air flows through the valve, and in the on position, water and air flow is permitted to the jets 36. If there is a single MNB jet, the section 60-8 will be connected directly to the MNB jet; if there is a plurality of MNB jets, section 60-8 can be a pipe manifold with a separate output for each MNB jet.

The system 50 further includes a second T fitting 62-2, with an inline port connected to the pipe section 60-3, a T port connected to pipe section 60-6, and the opposite inline port connected to pipe section 60-4, whose opposite end is connected through an elbow fitting to an input port of a motorized valve 64-3. The opposite end of pipe section 60-6 is connected to an input port of another motorized valve 64-2. The output port of valve 64-2 is connected to a pipe manifold 60-7, which serves the array of bath jets 32, or, in the case of a single bath jet, directly to the bath jet. The output port of valve 64-3 is connected to pipe section 60-5, whose terminal end is connected to a drain 38 for the tub. Typically, the drain connection will be to an overflow connection for the tub, so that water can be discharged whether the tub drain stopper is in place or not, for example, as described in U.S. Pat. No. 8,549,678, for an accelerated tub drain for a walk-in tub installation, the entire contents of which are incorporated herein by this reference.

The reconfigurable system 50 is configured to provide three functions, the MNB jet function, the water jet function, or the fast water discharge function, with a single pump. For the MNB function, the valve 64-1 is set to the on position, and valves 64-2 and 64-3 are set to the off position. With the pump operating, the entire pump discharge is sent to the MNB jets, and no water is sent to the jets 32 or to the drain. For the jet function, valves 64-1 and 64-3 are closed, and valve 64-2 is opened, sending all water to the bath jets 32 while the pump is operating. For the fast water discharge function, valves 64-1 and 64-2 are closed and valve 64-3 is opened, sending all water from the pump to the drain 38 while the pump is operating.

The pipe sections may be rigid pipe sections, flexible pipe sections or a combination of rigid and flexible. The valves are connected to the controller 40, which supplies control signals to the valves.

Figure 5:
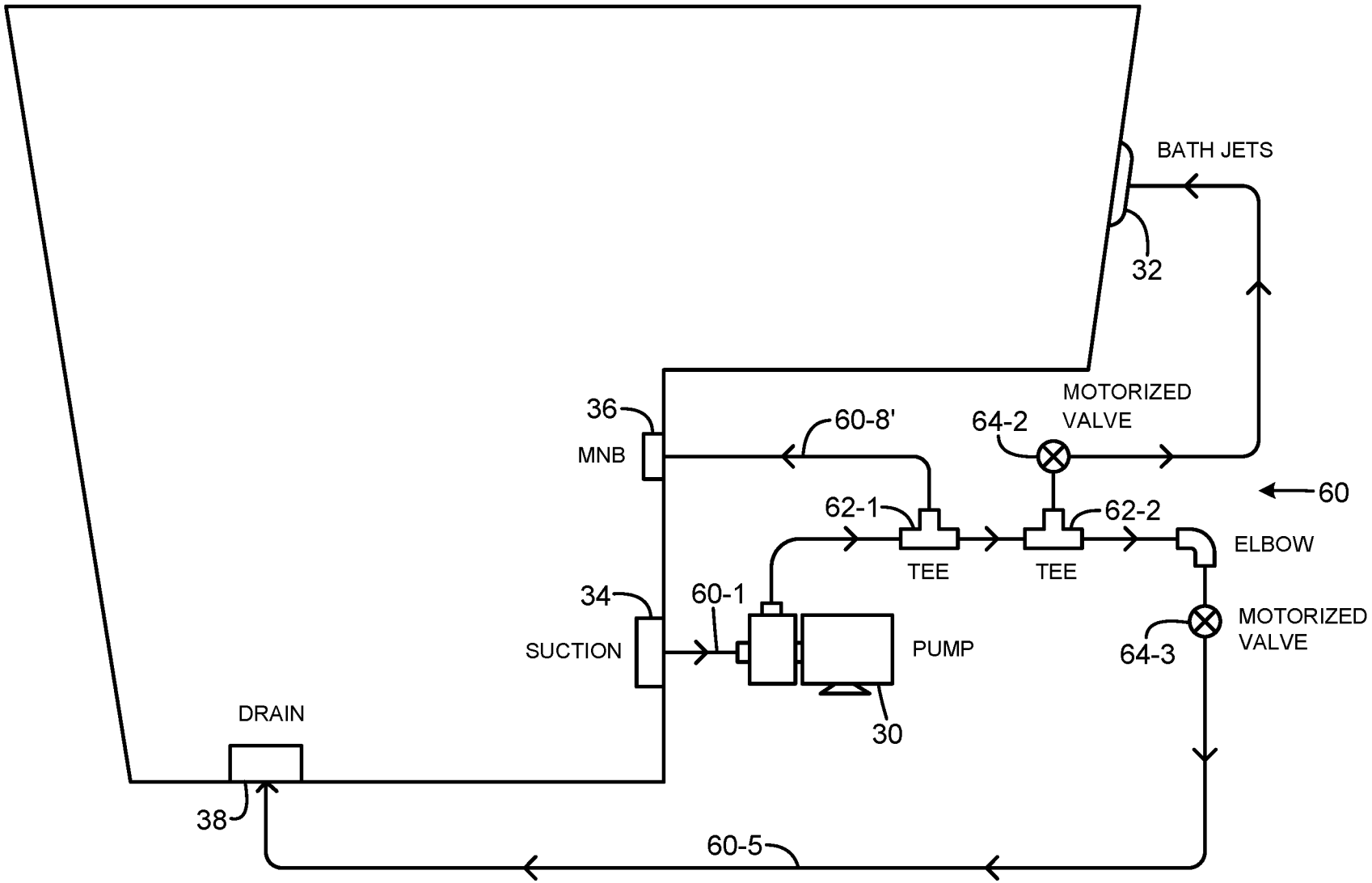
FIG. 5 is a simplified schematic diagram illustrating an alternate exemplary embodiment of a water distribution system employing a single pump to operate three functions in a walk-in tub installation.

FIG. 5 illustrates an alternate embodiment of a tub system configured for three function usage with a single pump, using a reconfigurable water distribution system 60, using only two valves 64-2 and 64-3. The system 60 is similar to system 50 (FIG. 4), except that the valve 62-1 is omitted, and the MNB pipe manifold 60-8' is connected directly to the T port of T fitting 62-1. In this embodiment, the MNB function is always active when the pump 30 is running. With valves 64-2 and 64-3 in the closed position, all water from the pump is sent to the pipe manifold 60-8'. For the bath jet function, valve 64-2 is put to the open position, and valve 62-3 to the closed position. In this configuration, some water is sent to the MNB jets, but most will be sent to the bath jets 32. For the fast water discharge function, valve 64-2 is put to the closed position, and valve 64-3 is opened. In this configuration, some water is sent to the MNB jets, but most will be sent to the drain 38.

Figure 6:
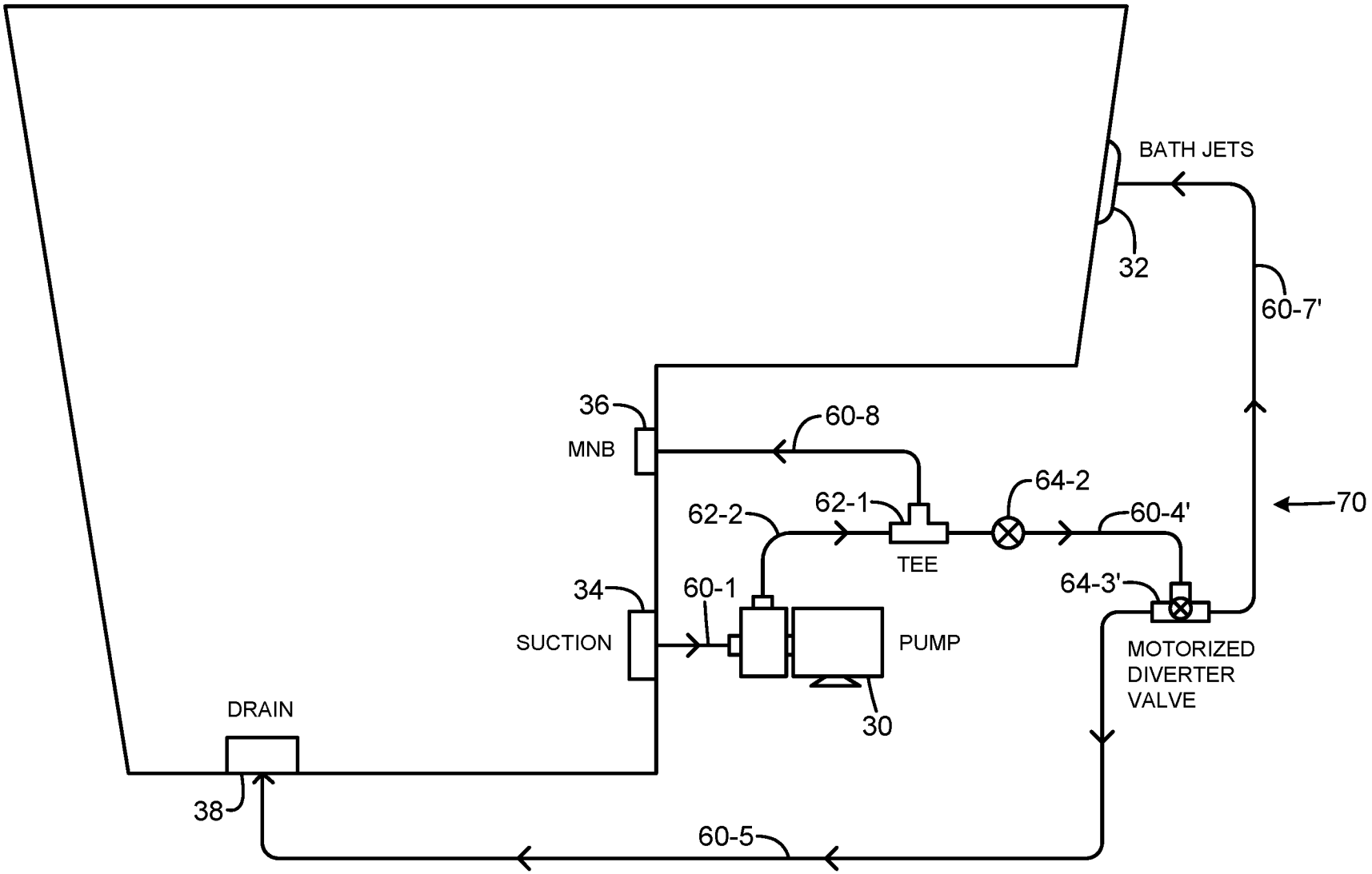
FIG. 6 is a simplified schematic diagram illustrating another exemplary embodiment of a water distribution system employing a single pump to operate three functions in a walk-in tub installation.

FIG. 6 illustrates another embodiment of a tub system with a reconfigurable water distribution system 70, configured to operate three functions with a single pump 30. The system 70 is similar to system 60 of FIG. 5, except that motorized valve 64-2 is moved and placed in the pipe section 60-4', valve 64-3 is replaced with a diverter valve 64-3', and pipe manifold section 60-7 is replaced with pipe manifold section 60-7' connected one output port of the valve 64-3', the other output connected through pipe section 60-5 to the drain 38. The diverter valve 64-3' has two settings, one in which the input port is connected to the output port connected to the bath jet manifold pipe section 60-7', and a second setting in which the input port is connected to the output port connected to the pipe section 60-5. In this embodiment, the MNB jet function is always active when the pump is opened. For an MNB function only, the motorized valve 64-2 is closed, so that all water from the pump is directed to the MNB jets 36. The bath jet function is selected by placing valve 64-2 in the open position, and setting the diverter valve to direct flow to the bath jets. Some water flows to the MNB jets, but most will flow to the bath jets. For the rapid water discharge function, valve 64-2 is opened, and the diverter valve is set to direct water to the port connected to the pipe section 60-5. Again, some water will flow to the MNB jets, but most will flow to the drain for discharge.

Figure 7:
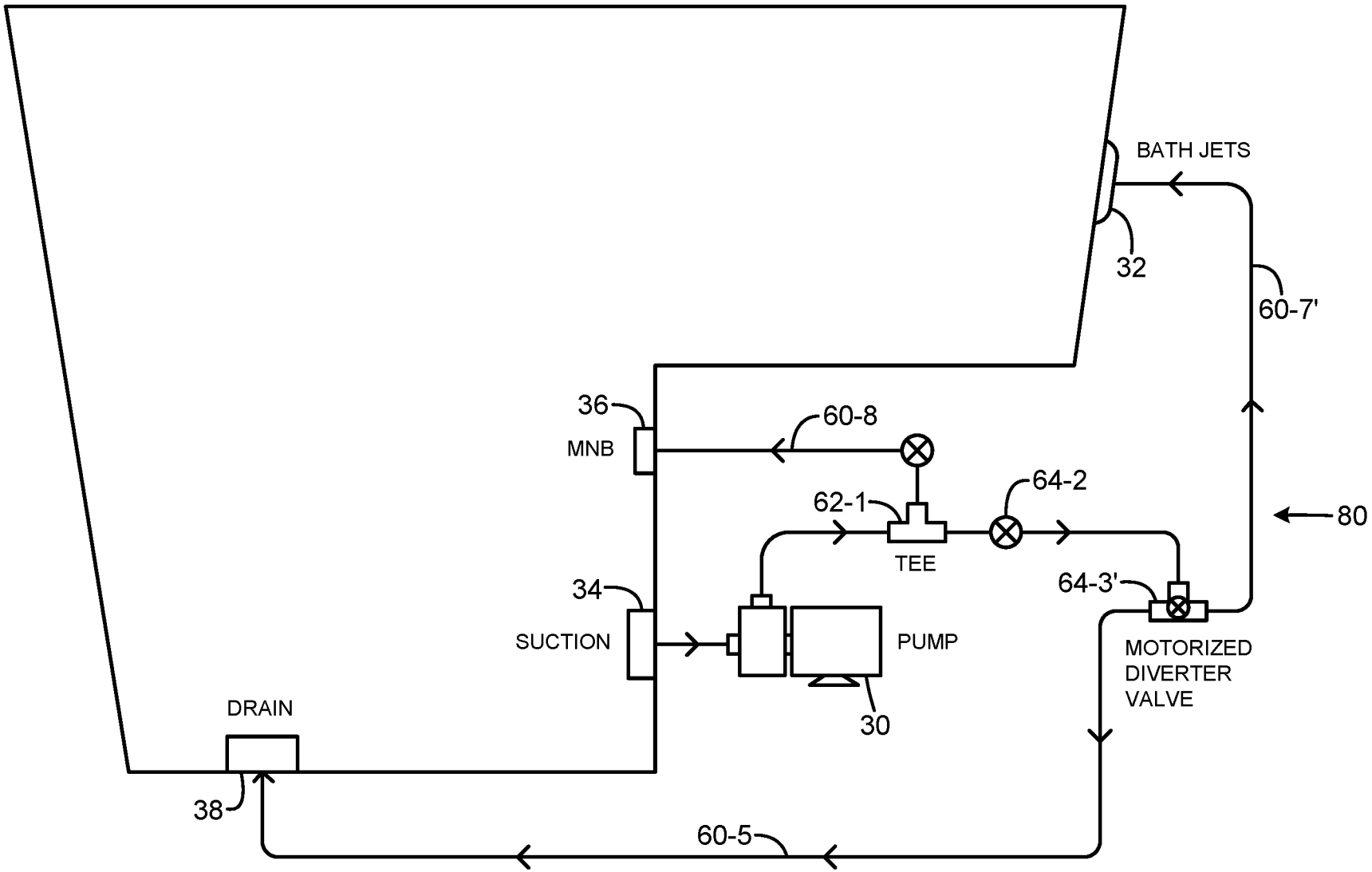
FIG. 7 is a simplified schematic diagram illustrating yet another exemplary embodiment of a water distribution system employing a single pump to operate three functions in a walk-in tub installation.

FIG. 7 shows in schematic form another embodiment of a tub system with a reconfigurable water distribution system. The system 80 uses two motorized open/close valves 64-1 and 64-2, and a motorized diverter valve 64-3'. The water distribution system is similar to that of system 70 (FIG. 6), except that the valve 64-1 is placed between the T fitting 62-1 and the pipe manifold section 60-8. This allows the path to the MNB jets to be closed when the system 80 is in the bath jets function mode or in the rapid water discharge mode.

Figure 8:
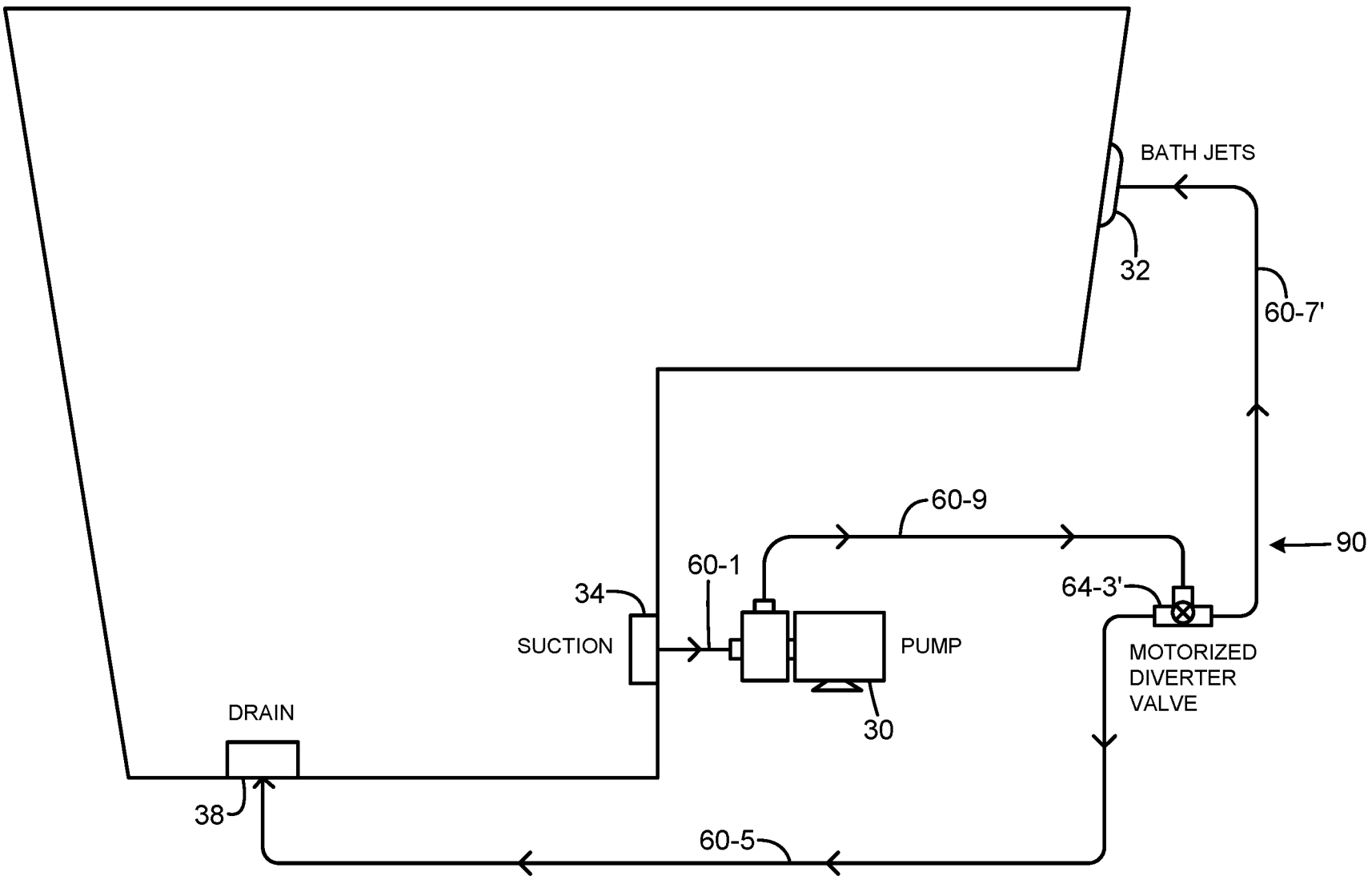
FIG. 8 is a simplified schematic diagram illustrating an exemplary embodiment of a water distribution system employing a single pump to operate two functions in a walk-in tub installation.

FIG. 8 illustrates a tub installation with a reconfigurable water distribution system 90, in which the tub does not include MNB jets. The system 90 provides two functions or mode of operation, a bath jet mode and a rapid water discharge mode, using a single pump 30, using a single diverter valve. In this embodiment, the pump pressure port is connected to pipe section 60-9, which runs to the input port of the diverter valve 64-3'. One output port of the valve is connected to pipe manifold section 60-7', which is connected to the bath jets 32. The other output port of the diverter valve is connected to the drain by pip section 60-5. The two modes of operation are selected by the position of the diverter valve 64-3', to thus provide either a bath jet mode or a rapid water discharge mode when the pump is operating.

Figure 9:
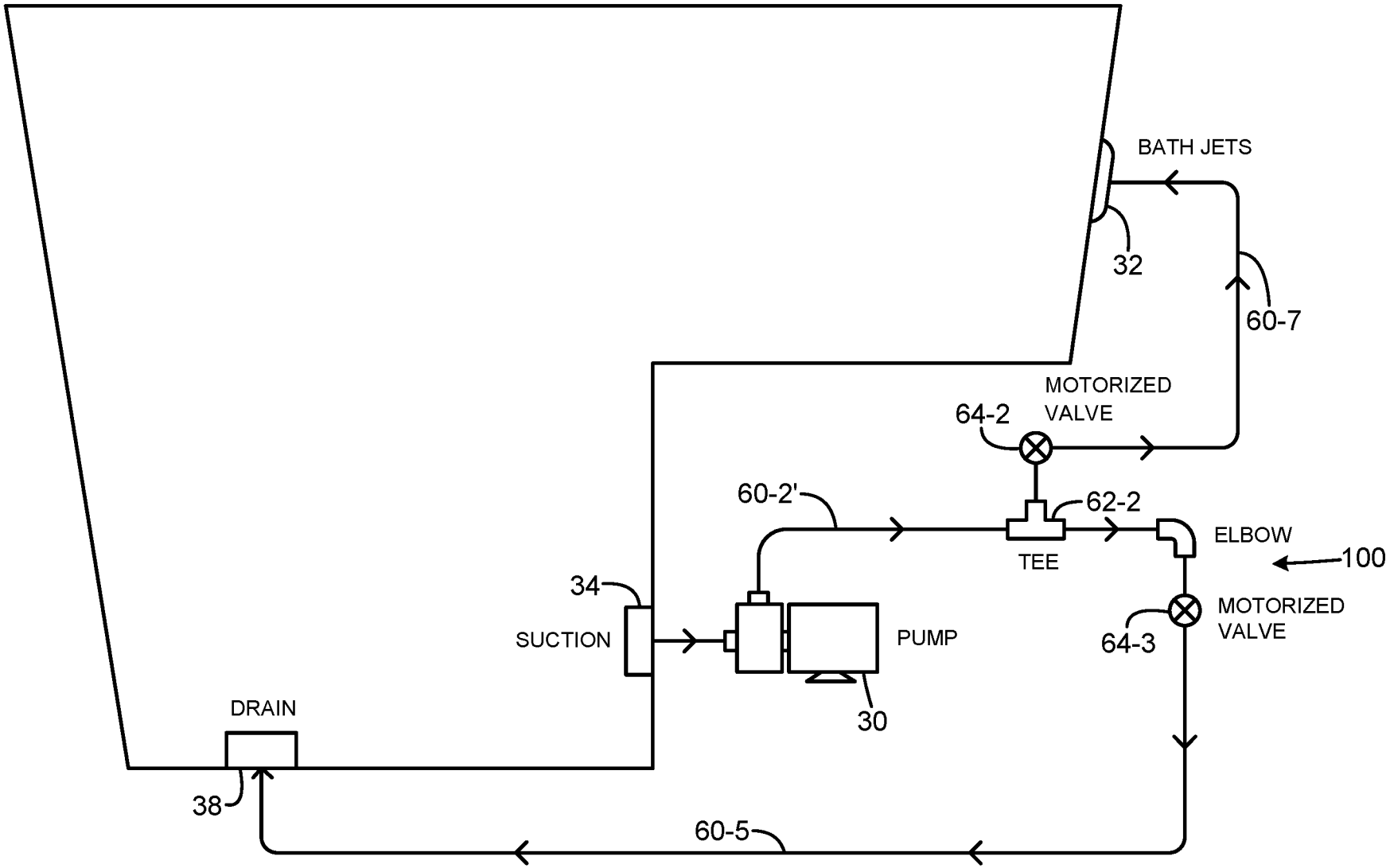
FIG. 9 is a simplified schematic diagram illustrating a second exemplary embodiment of a water distribution system employing a single pump to operate two functions in a walk-in tub installation.

FIG. 9 illustrates a tub installation with a reconfigurable water distribution system 100, in which the tub does not include MNB jets. The system 100 provides two functions or mode of operation, a bath jet mode and a rapid water discharge mode, using a single pump 30, using two motorized open/close valves. The system 100 is similar to system 50 (FIG. 4), except that the valve 64-1 and T fitting 62-1 are omitted. Pipe section 60-2' connects the pump output directly to the T fitting 62-2. To select the bath jets mode, valve 64-2 is opened, and valve 64-3 is closed, sending the entire output of the pump to the bath jets. To select the rapid water discharge mode, valve 64-2 is closed, and valve 64-3 is opened, sending the entire output of the pump to the drain. If both valves are opened, water will be distributed between the bath jets and the drain. Alternatively, the valve 64-2 may be connected to the drain fitting, and valve 64-3 connected to the bath jets, in any of the foregoing embodiments.

Although the foregoing has been a description and illustration of specific embodiments of the subject matter, various modifications and changes thereto can be made by persons skilled in the art without departing from the scope and spirit of the invention.

What is claimed is:

1. A reconfigurable water distribution system for a walk-in tub bathing installation including two types of discharge ports for discharging water, the system comprising:

a single motorized pump having an input connected to a suction port of the bathing installation, and an output port delivering pressurized water;

a pipe system connecting the outlet port of the pump to two types of discharge ports, the pipe system including a valve to configure a first water path and a second water path between the valve and a respective one of the two types of discharge ports to selectively direct the pressurized water of the two types of discharge ports;

said pipe system includes a first pipe section connecting the pump output port to an input port of the valve, said first water path comprises a second pipe section connected between a first outlet port of the valve and the first type of discharge ports, and said second water path comprises a third pipe section connected between a second outlet port of the valve and the second type of discharge ports;

wherein a first type of discharge ports is one or more bath jets, and wherein when setting the valve to direct pressurized water to the first type of discharge ports, a bath jetting function is performed;

wherein a second type of discharge ports is a drain discharge port for discharging pressurized water from the walk-in bathing installation for rapid draining to a sanitary drain and wherein when water is directed to the second type of discharge ports, a drain function is performed, wherein the valve in a first valve position directs water flow to the one or more bath jets, and in a second valve position prevents water flow to the one or more bath jets and allows water flow to the sanitary drain, and wherein the water distribution system selectively enables the walk-in bathing installation to perform at least two different functions using a single pump.

2. The system of claim 1, wherein the valve is an open/close valve controllable to a closed position blocking water flow to the second type of discharge ports while allowing water flow to the first type of discharge ports for the bathing jet function.

3. The system of claim 1, wherein the valve is an electrically controllable valve.

4. The system of claim 1, wherein the valve is a three port diverter valve.

5. A walk-in bath tub installation comprising:

a walk-in bath tub having a drain system, and one or more bath jets fitted in one or more walls of the tub to provide a whirlpool function, and a seat;

a reconfigurable water distribution system, comprising:

a single motorized pump having an input connected to a suction port of the tub, and an output port delivering pressurized water;

a pipe system connecting the pump output port to the one or more bath jets and the drain system, the pipe system including a valve to configure water paths between the pump, the one or more bath jets and the drain system to selectively direct the pressurized water to r either the one or more bath jets to perform a whirlpool function and to the drain system for a bath draining function.

6. The installation of claim 5, wherein the valve is electrically controllable by a controller.

7. The installation of claim 5, wherein the valve is an open/close valve controllable to a closed position blocking water flow to the drain system and allowing water flow to the one or more bath jets.

8. The installation of claim 5, wherein the valve is a three port diverter valve.

* * * * *